United States Patent [19]

Alfaro

[11] Patent Number: 4,986,791

[45] Date of Patent: Jan. 22, 1991

[54] PUPPET

[76] Inventor: Albert Alfaro, 3750 Richard La., Wantaugh, N.Y. 11793

[21] Appl. No.: 466,196

[22] Filed: Jan. 17, 1990

[51] Int. Cl.[5] ..... A63H 3/20

[52] U.S. Cl. ..... 446/361; 446/384

[58] Field of Search ..... 446/361, 384, 362, 338, 446/329, 327, 366, 367, 371, 370, 365, 330

[56] References Cited

U.S. PATENT DOCUMENTS

| | | | |
|---|---|---|---|
| 1,350,711 | 8/1920 | Dondo | 446/367 |
| 1,488,890 | 4/1924 | Muller | 446/338 |
| 1,608,134 | 11/1926 | Michel | 446/365 |
| 2,696,056 | 12/1954 | Kistler et al. | 446/366 X |
| 2,771,708 | 11/1956 | Enison | 446/367 |
| 3,212,213 | 10/1965 | Perego | 446/365 X |
| 3,391,485 | 7/1968 | Fosser | 446/365 |
| 3,698,127 | 10/1972 | Harp | 446/338 |
| 4,245,428 | 1/1981 | Bowen | 446/366 |
| 4,894,936 | 1/1990 | Van Heumen et al. | 446/362 X |

FOREIGN PATENT DOCUMENTS

| | | | |
|---|---|---|---|
| 811331 | 8/1951 | Fed. Rep. of Germany | 446/362 |

*Primary Examiner*—Mickey Yu

*Attorney, Agent, or Firm*—Nolte, Nolte & Hunter

[57] ABSTRACT

A puppet includes a body, a head disposed above the body and a flexible spine for connecting the back of the head to the back of the body. A cable assembly is used for actuating the head in vertical and horizontal motion. The cable includes a sheath and a flexible yet stiff cable within the sheath. The sheath is fixedly embedded in the torso of the body. The cable passes through the sheath, out the top of the body and is secured fixedly to the underside of the head in an area corresponding to the neck of the puppet. The cable extends out from a distal end of the sheath.

7 Claims, 2 Drawing Sheets

PUPPET

The present invention relates to a puppet having a remotely actuable head.

BACKGROUND OF THE INVENTION

In the art, there are various ways and means of actuating the head of a puppet. These range from coupling the puppet's head to a solid remotely actuable rod, such as in U.S. Pat. No. 1,608,134 to Michel; moving the head by hand as in a standard ventriloquist puppet; operating the head by traditional puppet strings; or using an internal control line as in Fosser, U.S. Pat. No. 3,391,485.

The present invention provides a novel and surprisingly lifelike range of motion using an extremely simple, inexpensive, and easily available mechanism: a bicycle hand-brake cable.

The puppet comprises a substantially solid body portion and a substantially solid head portion. The head portion is attached to the body portion flexibly as by means of a felt strip running between the back of the bottom of the head and the top of the back of the body. The felt strip corresponds in location to what would be the spine of the puppet. A passageway is formed from approximately the small of the back through the center of what would be the neck between the top of the torso and the bottom of the head. In this passageway, through the torso, is embedded in fixed fashion a flexible sheath of a bicycle brake cable assembly. Running through the sheath is the brake cable itself. Brake cables generally come equipped with a tab or toggle for attachment to a handlebar mounted brake-actuating handle. This toggle is located distal to the puppet at the outside of the sheath and the cable has sufficient length to permit the toggle to travel towards and away from the end of the sheath. The untoggled end of the cable is embedded in the head of the puppet. The cable may be rotated about its longitudinal axis causing horizontal rotation of the puppet's head; i.e. side to side as in shaking the head "no". The toggle at the distal end of the cable facilitates such rotation. The cable can also be slid axially in and out of the sheath which causes vertical nodding of the puppet's head. The felt strip permits horizontal and vertical motion of the head while imparting a certain angularity to some of the motions, which results in a slightly tilted head, resulting in a surprisingly lifelike, expressive and cute appearance to the motion of the puppet's head.

It is the object of this invention to provide a lifelike and very appealing puppet having a novel and appealing animation of the head, remotely actuable by an operator, while the puppet is perched on the operator's shoulder. It is a further object of this invention that the puppet be easily fabricable using readily available, off-the-shelf, inexpensive parts such as a bicycle brake cable. It is a further object of the invention that the puppet be sturdy, simple and reliable in construction and operation to provide durability and quality.

DETAILED DESCRIPTION OF THE DRAWINGS

Figure 1:
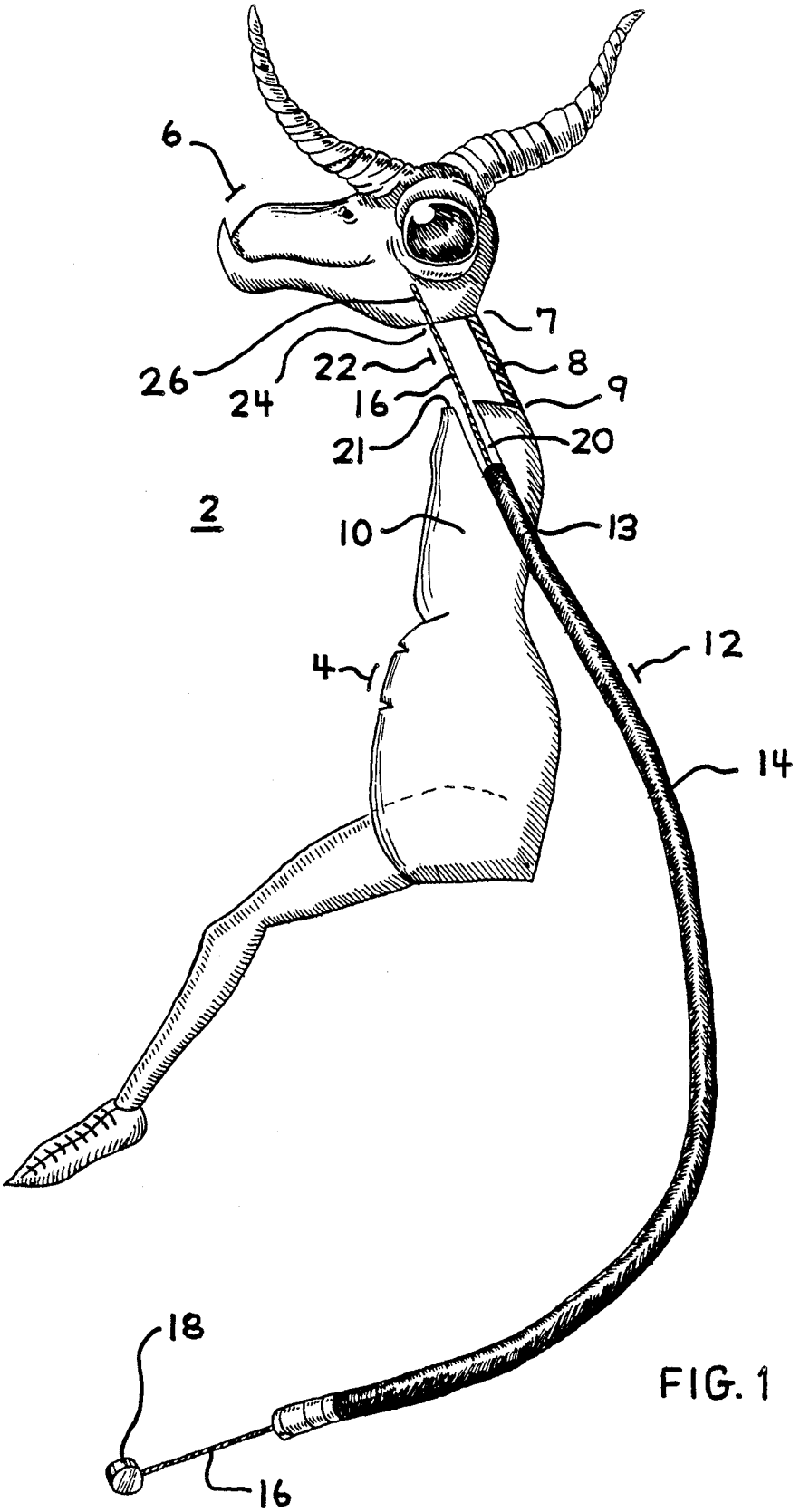
FIG. 1 is a view, in section from the side of the puppet, of the present invention.

FIG. 1 shows the puppet, generally designated 2, comprising a body 4 and a head 6. The head 6 is joined to body 4 by felt 8 which is attached at the base 7 of the back of head 6 in spaced relation to the top 9 of the back of torso 10 of body 4. A cable assembly 12 is embedded in the body through back 13 of torso 10. Cable assembly 12 comprises sheath 14 and cable 16. Essentially, cable 16 must be both stiff and flexible. It must be stiff enough to translate rotational and axial motion through sheath 14, yet flexible enough to bend within flexible sheath 14. Cable assembly 12 is preferably a bicycle hand-brake cable assembly. There is a toggle 18 at the end of the cable 16 distal from puppet 2. Toggle 18 is affixed to the distal end of cable 16. Sheath 14 is fixedly embedded in passageway 20 through torso 10. Passageway 20 enters the back at point 13 and exits through the top 21 of torso 10 below neck area 22. Neck area 22 is located between head and body, where a human or animal neck would be. Bare end 26 of cable 16 is embedded sufficiently deep in head 6 to provide a secure and fixed attachment thereto.

Figure 2:
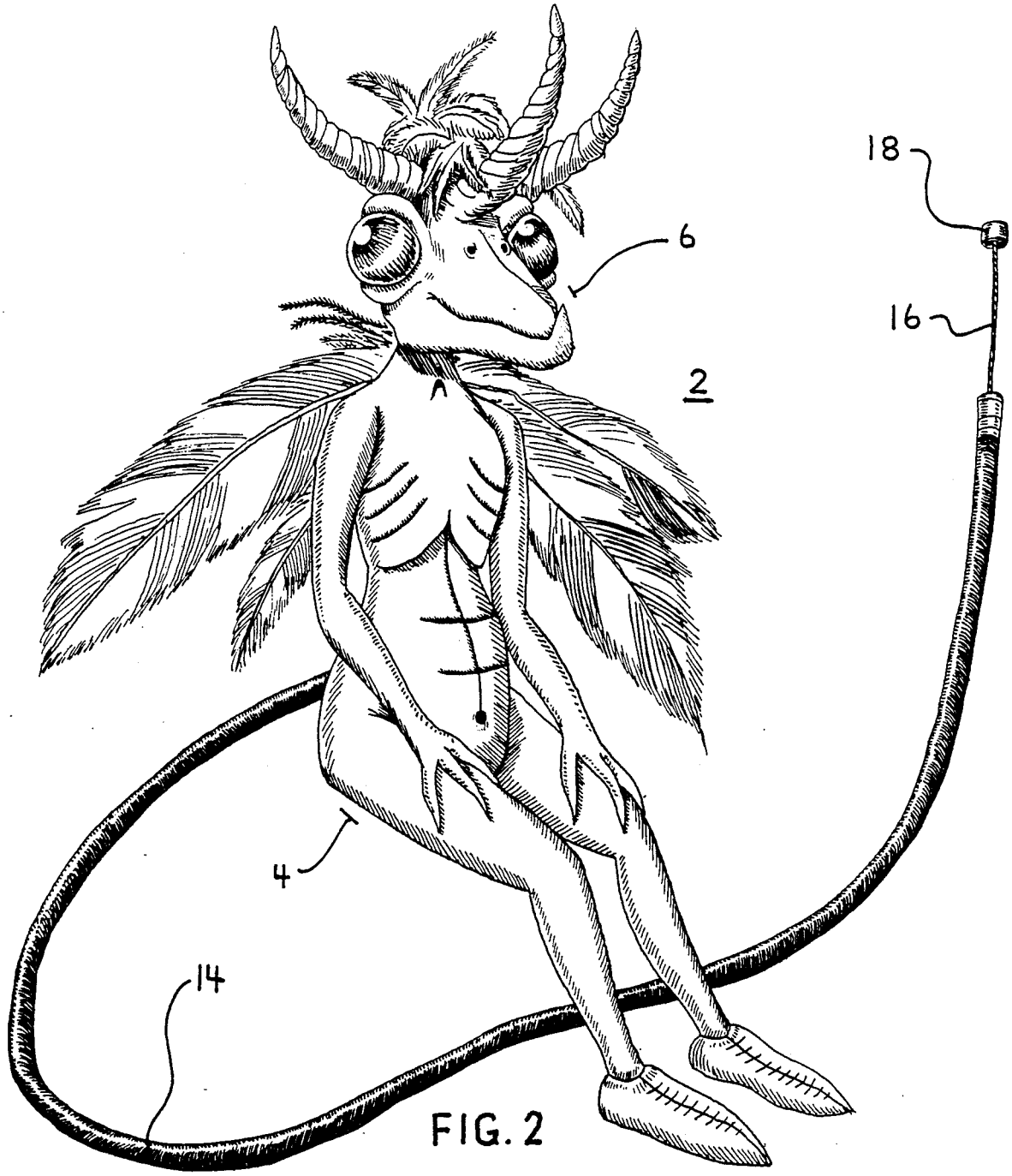
FIG. 2 is a perspective view of the puppet of the present invention.

In use, puppet 4 is perched upon the shoulder of the puppeteer (not shown). Brake cable assembly 12 is snaked behind the back or through the sleeve of the puppeteer. With the sheath through the sleeve of the puppeteer, the sheath is held reasonably unmoving by the puppeteer's sleeve, and cable 16 is free to be slid axially in and out of the cable sheath and rotated coaxially within the sheath. This motion is translated by the cable to the puppet's head 6. Toggle 18 is grasped by the fingers of the hand and provides a secure grip for actuation by said hand. When toggle 18 is slid towards or away-from the sheath, the cable causes the head to nod up and down as it pivots on its felt attachment 8. This simulates a nod "yes". When a toggle, such as 18 in FIG. 1, or the more conveniently shaped toggle 18, in FIG. 2 is rotated, the motion is translated through the cable to the head which rotates from side to side horizontally as though it were shaking its head "no". When these motions are taken to their extreme ranges, or when a nodding up-down motion is combined with a rotational motion, a resulting tilt of the head is somewhat comical and surprisingly expressive.

In combination with the inventor's imaginative faces and bodies, the unique and expressive motion of this puppet has already resulted in a great deal of commercial success, even with the inventor's present expensive production techniques for production of the body in limited numbers.

FIG. 2 shows puppet 4 as it appears to the audience of the puppeteer.

I claim:

1. A puppet comprising:

a body;

a head disposed above said body;

flexible spine means for connecting a back of the head to a back of the body;

a cable assembly means, forward of said spine means, for supporting and actuating the head in vertical and horizontal motion said means comprising:

a sheath; and a flexible yet stiff cable within said sheath;

the sheath being fixedly embedded in a torso of the body; and the cable passing through the sheath, out the top of the body, and secured fixedly to the underside of the head in an area corresponding to a neck of the puppet, said cable extending out from a distal end of the sheath.

2. A puppet according to claim 1 in which the cable assembly is a bicycle hand-brake cable assembly.

3. A puppet according to claim 1 in which the flexible spine is a fabric strip.

4. A puppet according to claim 3 in which the fabric strip is felt.

5. A puppet according to claim 1 in which the sheath extends from the back of the body towards the top of the body.

6. Apparatus according to claim 1 having toggle means, affixed at the distal end of the cable, for manipulating the cable.

7. A puppet comprising:

body means for perching on a puppeteer's shoulder;

a head disposed above said body;

flexible felt fabric strip spine means for connecting a back of the head to a back of the body;

a flexible yet stiff bicycle hand-brake cable assembly means for actuating the head in vertical and horizontal motion, said means comprising:

a sheath, and a flexible yet stiff cable within said sheath;

the sheath being fixedly embedded in a torso of the body, said sheath extending from the back of the body, through the torso, and towards the top of the body;

the cable passing through the sheath, out the top of the body, and secured fixedly to the underside of the head in an area corresponding to a neck of the puppet, said cable extending out from a distal end of the sheath; and said cable having toggle means on a distal end of the cable.

* * * * *